US006476838B1

(12) United States Patent
Italiano

(10) Patent No.: US 6,476,838 B1
(45) Date of Patent: Nov. 5, 2002

(54) METHOD OF DRIVING A THERMAL PRINT HEAD

(75) Inventor: Victor John Italiano, Glenmoore, PA (US)

(73) Assignee: Oki Data America, Inc., Mt. Laurel, NJ (US)

( * ) Notice: Subject to any disclaimer, the term of this patent is extended or adjusted under 35 U.S.C. 154(b) by 0 days.

(21) Appl. No.: 09/390,390

(22) Filed: Sep. 3, 1999

(51) Int. Cl.[7] ..... B41J 2/37; B41J 2/36
(52) U.S. Cl. ..... 347/192; 347/211
(58) Field of Search ..... 347/10, 191–192, 347/210–211, 185, 59, 171; 400/20.12; 324/678, 703, 705, 707, 711, 718

(56) References Cited

U.S. PATENT DOCUMENTS 3,965,330 A * 6/1976 Williams ..... 347/210
4,113,391 A * 9/1978 Minow ..... 400/120.12
4,415,904 A 11/1983 Inui et al.
4,523,203 A 6/1985 Adkisson et al.
4,633,269 A 12/1986 Mikami et al.
4,769,657 A * 9/1988 Takahashi ..... 347/171
4,875,056 A 10/1989 Ono
4,887,092 A 12/1989 Pekruhn et al.
4,897,667 A * 1/1990 Uchiyama et al. ..... 347/10
5,075,698 A * 12/1991 Aoki et al. ..... 347/183
5,359,352 A 10/1994 Saita et al.
5,451,988 A * 9/1995 Ono ..... 347/185
5,453,776 A 9/1995 Günther
5,517,224 A * 5/1996 Kaizu et al. ..... 347/59
5,519,417 A 5/1996 Stephany et al.
5,559,535 A * 9/1996 Otsuka et al. ..... 347/14
5,706,043 A 1/1998 Okada et al.
5,838,356 A 11/1998 Günther et al.
6,204,671 B1 * 3/2001 Katsuma ..... 324/678

* cited by examiner

*Primary Examiner*—Anh T. N. Vo
*Assistant Examiner*—K. Feggins
(74) *Attorney, Agent, or Firm*—Akin, Gump, Strauss, Hauer & Feld, L.L.P.

(57) ABSTRACT

A control circuit for improving the rate of heat input to a thermal print head of a thermal printing apparatus includes a switch which is operably linked to a power source and to the print head of the thermal printing apparatus to provide a control pulse sequence to the print head. The control pulse sequence includes a first pulse and a second pulse. A control circuit timer is provided for operating the switch at the end of the first pulse to provide a second pulse. The first pulse has a first electrical potential and is applied to the print head for a first duration to heat the print head to the desired temperature for activating the print mode. The second pulse has a second electrical potential lower than the electrical potential of the first pulse and is of a second duration for maintaining the printing temperature of the printing head. The control pulse sequence provides an improved rate of heat input to the print head by decreasing the time required for the print head to attain the predetermined printing temperature and maintains this temperature for the duration of the second pulse.

14 Claims, 3 Drawing Sheets

METHOD OF DRIVING A THERMAL PRINT HEAD

BACKGROUND OF THE INVENTION

This invention relates generally to a control circuit and associated method of driving a thermal print head of a thermal printing apparatus, and more particularly to a control circuit providing a control pulse sequence to activate the print head and improve the rate of heat input thereto.

Thermal printers utilize thermal print heads to transfer print data to a thermally sensitive media. A print head has an active surface containing resistive elements, the elements are activated or "heated" by applying a control voltage to the resistive elements of the print head. A control circuit activates the print head with a control voltage pulse of sufficient duration to cause the resistive elements of the print head to heat to a desired temperature. Upon activation, the elements are brought into contact with the thermally sensitive media, typically a recording media or a toning transfer ribbon. In this way, thermal energy is transferred from the print head by conduction to the ribbon or recording media.

As a thermal print head is activated, much of the heat produced by the resistive elements is retained in the print head resulting in a significant temperature rise of the print head, as many elements are typically activated in a short period of time. Repeated activation of the print head by the control circuit results in residual heat energy contributing to the overall thermal energy transferred to the ribbon or recording media. Therefore, less additional energy is required from a control circuit to produce an impression on a recording media with a such "warm" print head. As such, many modem print heads incorporate thermistors or other devices that provide a measurement of the temperature of the print head. The energy to the warmed resistive elements can then be proportionately reduced by reducing the length of time the warm resistive elements are activated. This is done in a manner that provides for relatively constant energy per impression to the ribbon or print media.

Some thermal printers also use control circuit logic to determine how much energy to supply to a resistive element and then change the length of time the resistive element is activated accordingly. This is done by adding up the activations of resistive elements over given lengths of time, converting the time to energy delivered, and calculating the temperature rise of the print head. The conversion from time to energy delivered is possible because the thermal properties of the print head and its surrounding area are known. The local temperature rise in the area of resistive elements that will subsequently be used can also be calculated enabling the use of individualized voltage pulse widths to make impressions at the proper thermal energy levels.

The operation of thermal print heads has also been advanced by providing preheat current to the resistive elements. i.e., providing a small amount of current to the resistive elements to bring the temperature of the resistive elements up to a level that is just below the operating temperature required to make an impression on the recording media. This allows a minimum amount of additional energy to activate the print head to make an impression on the media, and maximizes the speed of the printer. The additional amount of energy required to reach the operating temperature depends on the degree of prior usage and the resultant temperature of the print head. Such parameters are either determined with a temperature measuring sensor of the control circuit or by counting prior resistive element activations and calculating the current print head temperature.

Presently, the efficiency in thermal print head operation has been limited to the aforementioned methods of improving the amount of energy necessary to reactivate a previously active or warm head. It is desirable for a control circuit to improve the rate of heat input to a thermal printing head such that the heating time of the thermal print head is reduced independent of the temperature of the print head prior to activation.

The present invention is directed to a method of activating a print head to further increase the speed of a thermal printer by maximizing the rate of heat input into a resistive element independent of the temperature of the print head prior to activation.

BRIEF SUMMARY OF THE INVENTION

Briefly stated, the present invention provides a control circuit for driving a thermal print head of a thermal printing apparatus. The control circuit improves operation of a thermal printing apparatus by maximizing the rate of heat input into a thermal print head, thereby improving the printing cycle time independent of the temperature of the print head prior to activation. The control circuit applies a first high voltage pulse to the print head, then switches to a second voltage pulse lower in potential than that of the first pulse during the energizing period to prevent the element from being driven to a damaging temperature.

Specifically, the control circuit includes a switch which is operably linked to a power source and to the print head of the thermal printing apparatus to provide a control pulse sequence to the print head. The control pulse sequence includes a first pulse and a second pulse. The first pulse has a first electrical potential and is applied to the print head for a first duration to heat the print head to the desired temperature for activating the print mode. The second pulse has a second electrical potential lower than the electrical potential of the first pulse and is of a second duration for maintaining the printing temperature of the printing head. A control circuit timer is provided for operating the switch at the end of the first pulse to provide the second pulse. In this way, the pulse control sequence provides an improved rate of heat input to the print head by decreasing the time and energy required for the print head to attain the predetermined printing temperature and maintaining this temperature for the duration of the second pulse.

Additionally, a method of driving a print head of a thermal printing apparatus is provided wherein a first electrical potential of a control pulse sequence is applied to the print head for a first duration, then the electrical potential applied to the print head is switched from the first electrical potential to a second electrical potential. The second electrical potential is lower than that of the first electrical potential and is applied to the print head for a longer duration to provide an improved rate of heat input to the print head.

BRIEF DESCRIPTION OF THE SEVERAL VIEWS OF THE DRAWINGS

The foregoing summary as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

The present invention provides a control circuit for driving a thermal print head of a thermal printing apparatus to decrease the cycle time of thermal printing by maximizing the rate of heat input into the thermal print head independent of the temperature of the print head prior to activation. "Cycle time" as used herein refers to the time period between the time of initial activation and the time it takes the temperature of the print head to return to the original standby level.

Figure 1:
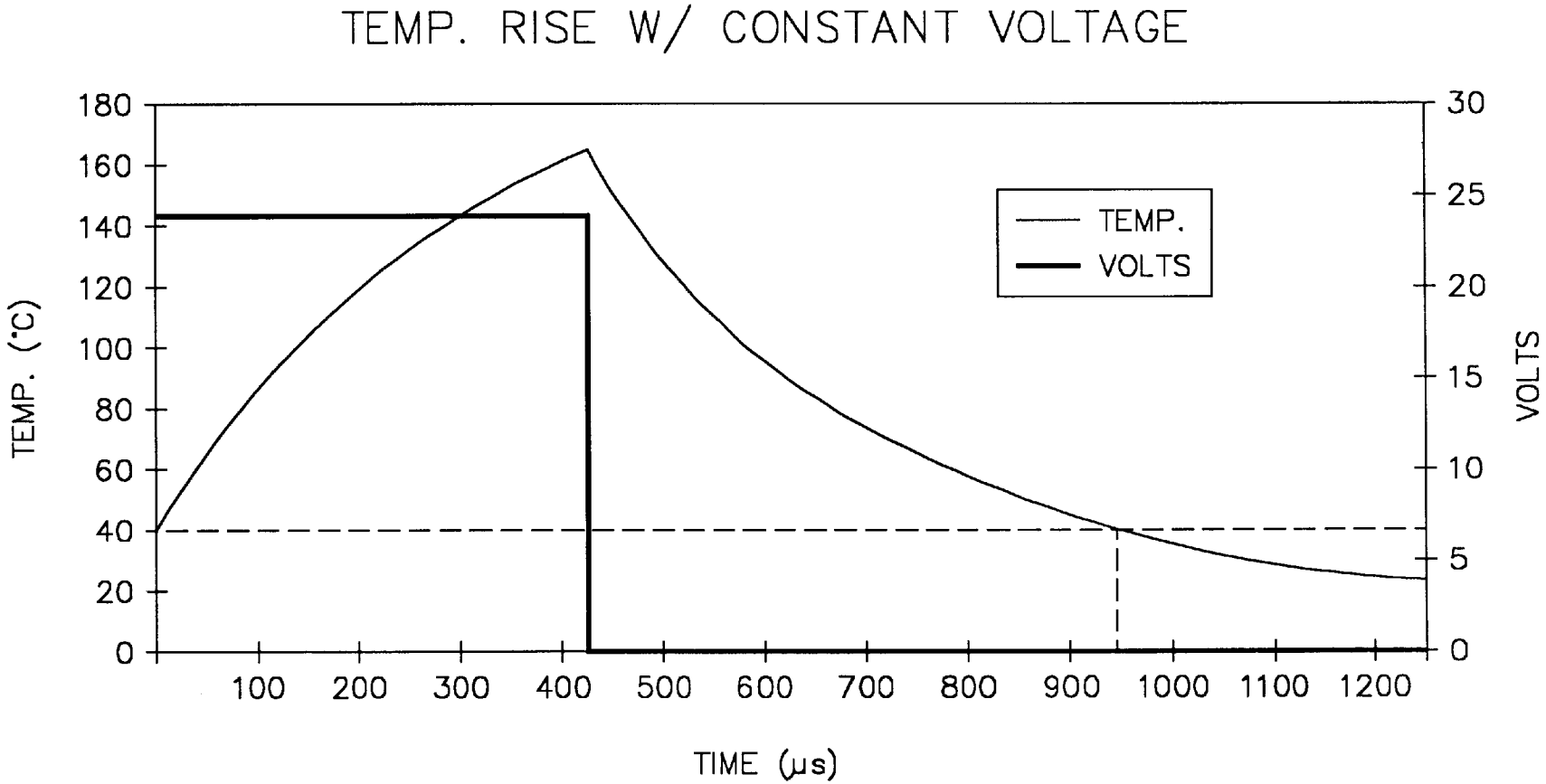
Fig. 1 (Prior Art)
FIG. 1 is a temperature/time graph showing the energizing period of a prior art print head.

Referring to the drawings, and more particularly FIG. 1, a prior art method of activating a thermal print head is shown, illustrating the printing cycle time and associated temperature rise for a typical resistive element activation as calculated by a thermal model. In the illustrated case, a continuous 24V pulse is applied to the resistive elements of the print head to raise the temperature to the desired print temperature, for a duration of about 420 microseconds. The temperature of the print head continually rises and reaches a peak temperature of 164 C. The total thermal energy input to the print head during this period is 440 mJ, 243 mJ being transferred to the media. The control voltage applied to the print head is then removed and the resistive elements return to their original standby temperature of 40 C. at about 940 microseconds from the activation time. Thus, the prior art method of activation shown in FIG. 1 has a total cycle time of 940 microseconds.

Figure 2:
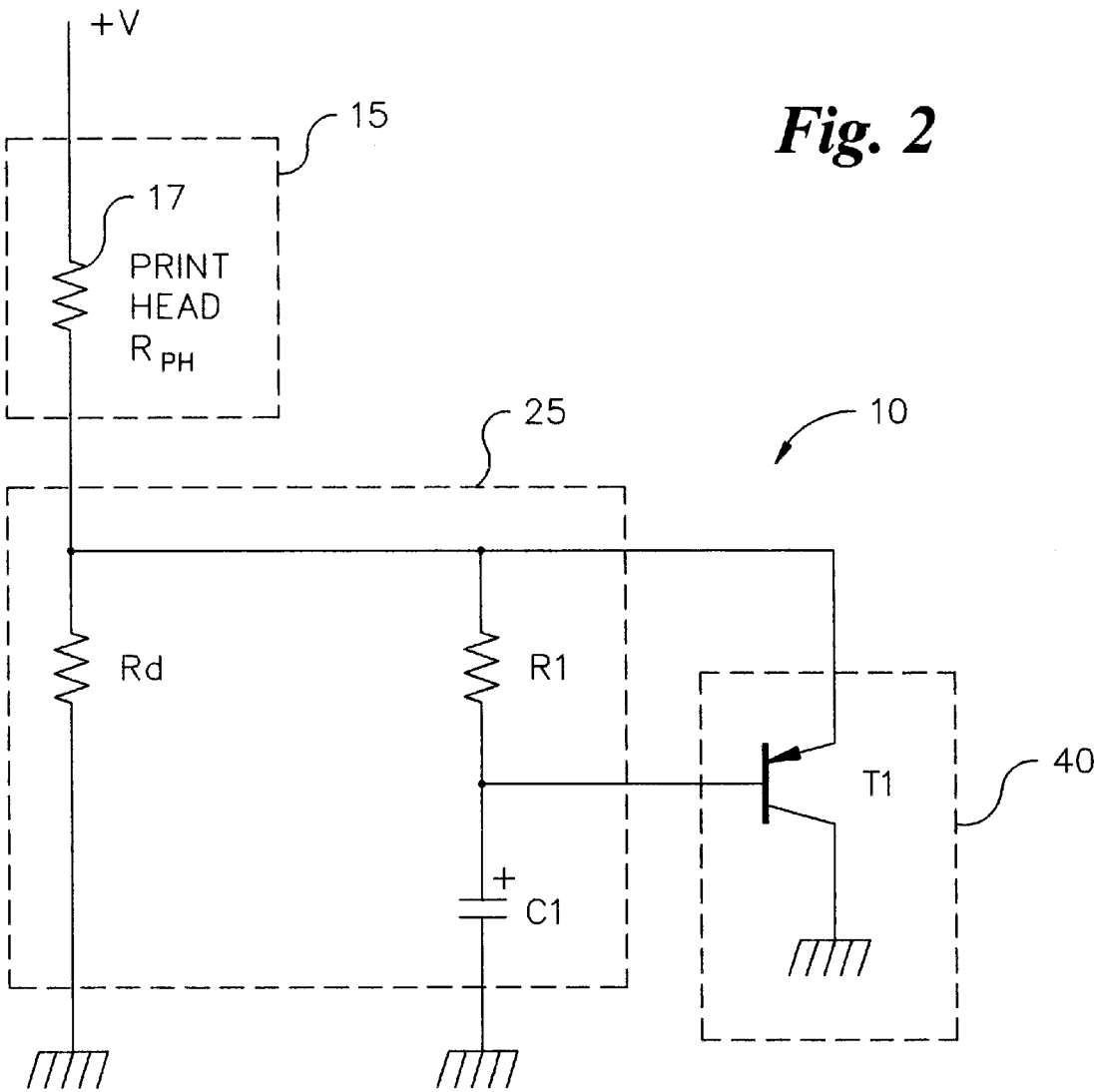
FIG. 2 is a schematic diagram of a control circuit in accordance with a preferred embodiment of the present invention.

Referring to FIG. 2, a thermal printing apparatus employing the essential elements of a control circuit 10 in accordance with the present invention is shown. The control circuit 10 includes a switching section 40, a pulse timing section 25, and a print head section 15. The pulse timing section 25 includes a capacitor Ct, and resistors Rt and Rd. Resistor Rt is connected in series with capacitor Ct, resistor Rd is connected in parallel with resistor Rt and capacitor Ct.

The switching section 40 includes a PNP switching transistor T1, the collector of T1 is connected to ground, the base of T1 is connected to capacitor Ct of the pulse timing section 25, and the emitter is connected to the resistor Rt of the pulse timing section 25. The print head section 15 includes a resistor Rph which represents the electrical model of the resistive elements of the print head 17.

In contrast to FIG. 1, the control circuit 10 of the present invention applies an initial high voltage pulse to the print head or "resistive element" 17, thus quickly heating the resistive element 17, then the control circuit 10 switches to a second lower voltage pulse during the activation period to prevent the resistive element 17 from being driven to a damaging temperature. The pulse timing section 25 actuates the switching section 40 to deliver the above-described pulse sequence. In this way, the pulse control sequence provides an improved rate of heat input to the resistive element 17, thereby decreasing the printing cycle time required for the resistive element 17 to attain the predetermined printing temperature and return to its standby temperature.

Specifically, the control circuit 10 activates the resistive element 17 as supply voltage V is applied to the circuit. Initially, current flows through the resistive element 17 and through PNP transistor T1 of switching section 40 because the transistor T1 is in a conducting or "on" state. The current conducting through resistive element 17 reaches ground through transistor T1. As current is conducted through resistive element 17, the voltage drop across resistive element 17 is approximately equal to the applied voltage V, the level of voltage being generally equal to the potential of the first pulse. It is recognized by those skilled in the art that alternative biasing arrangements and devices exist to accomplish the switching function of T1, for example an NPN transistor, FET, or relay may be substituted for transistor T1.

As current conducts through resistive element 17 to ground through transistor T1, capacitor Ct is charged through resistor Rt. After a duration determined by the time constant of Ct and Rt, the voltage level of capacitor Ct reaches the biasing level of transistor T1, effectively switching the transistor to a non-conducting or "off" state, blocking current flow through the transistor T1. Thus, current previously conducted through the transistor T1 to ground is blocked by the change in potential at the base of transistor T1 of the pulse timing section 25. The capacitance of capacitor Ct and resistance of resistor Rt are selected so that the charged voltage of Ct turns off the transistor after a duration defined as the first pulse duration which is sufficient to heat the resistive element 17 to a desired temperature..

Once current flow through the transistor T1 is blocked, current is conducted to ground through resistor Rd. As current flows through Rd some of the voltage is dropped across Rd, reducing the amount of voltage dropped across resistive element 17. In this way, the level of the voltage at the resistive element 17 is effectively switched to a decreased level. The duration of the first voltage level is a function of the resistor Rt and the capacitor Ct. The duration of the second voltage level is dependent upon the amount of energy required to perform the specific print operation, the second pulse ends when the voltage V is removed from the control circuit 10 by external circuitry (not shown).

The resistance value of Rd is determined by calculating the temperature at which the resistive element 17 must operate. Once the temperature is determined the value of RD is chosen to drop a voltage level corresponding to the difference between the first voltage level and the second voltage level. Thus the voltage level of the second pulse is equivalent to V−V/RD. In this way, the present invention provides a bi-level pulse with a fixed voltage ratio and fixed time of application of each voltage level or pulse. It is understood by those skilled in the art that alternative methods of delivering a bi-level voltage pulse to a print head are known such as pulse width modulation which provides active manipulation of the effective voltage applied to the resistive element 17 as well as the time based shaping of the pulse.

In an alternative embodiment, upon removal of the voltage V from resistive element 17, a second standby voltage may be applied to resistive element 17 to provide preheating of the element for further reduction in the cycle time.

Figure 3:
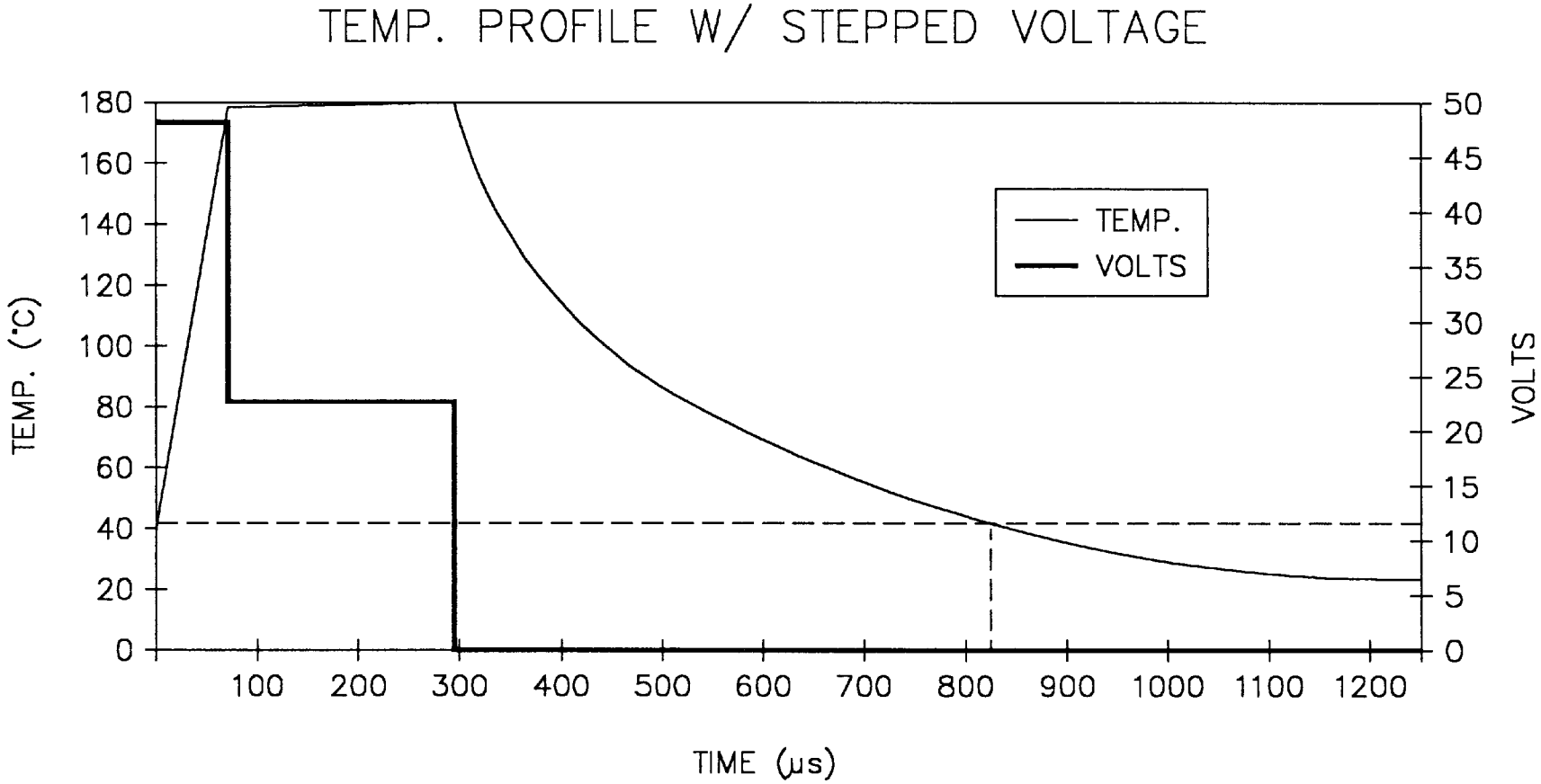
FIG. 3 is a temperature/time graph showing the energizing period of a print head in accordance with a preferred embodiment of the present invention.

Referring now to FIG. 3, the cycle time of the control circuit 10 of FIG. 2 is shown demonstrating the improved rate of heat input to the resistive element 17. In comparison to the prior art method of FIG. 1, a pulse sequence is applied to the resistive element in the same thermal model, here V is 48V, the first pulse, is applied for 60 microseconds (time to charge Ct to reverse bias T1). The first pulse drives the temperature of the resistive element 17 up to about the same peak temperature as the prior art method shown in FIG. 1. However, the temperature rise is accomplished in 60 microseconds instead of 440 microseconds. At this point, transistor T1 is switched to an "off" state and the second pulse having a voltage of 23V is applied. The second pulse sustains the resistive element 17 at the peak temperature for a period of time sufficient to generate an equivalent amount of heat energy in the element as was generated in FIG. 1. For the case of a constant applied voltage shown in FIG. 1, it takes about 440 microseconds for the resistive element 17 to generate the desired amount of heat. Using the pulse sequence of the control circuit 10 as shown if FIG. 3, the time to generate an equivalent amount of heat is reduced to 280 microseconds.

The total printing cycle time in FIGS. 1 and 3, as previously stated, is measured from the time of activation to the time it takes the temperature of the resistive element 17 to return to the original standby level, in this case, 40 C. When the resistive element 17 is activated at a single voltage level (FIG. 1), it takes 940 microseconds for a full printing cycle. The total cycle time is reduced to 827 microseconds when the pulse sequence of operation of the circuit of FIG. 2 is used. Such a reduction in cycle time translates to a 12% increase in print speed.

It will be appreciated by those skilled in the art that changes could be made to the embodiment described above without departing from the broad inventive concept thereof. For example, while the methods described herein are disclosed using discrete components, the control circuit described can be software driven or formed from known programmable logic packages such as PLA's, PLG's, microcontrollers, and the like. It is understood, therefore, that this invention is not limited to the particular embodiment disclosed and is not intended to exclude known equivalents, thus it is intended to cover modifications within the spirit and scope of the present invention.

I claim:

1. A control circuit for driving a thermal print head of a thermal printing apparatus, the print head oriented to transfer thermal energy to a thermally sensitive media, the print head transferring thermal energy to the media when operating in a printing mode upon reaching a desired printing temperature, the control circuit comprising:

a switch operably linked to a power source and to the print head to provide a control pulse sequence, the control pulse sequence including a first pulse and a second pulse, the first pulse having a first electrical potential and being applied to the print head for a first duration to heat the print head to the desired temperature for initiating the print mode, and the second pulse having a second electrical potential lower than the electrical potential of the first pulse and being of a second duration to maintain the printing temperature of the printing head; and a timer for operating said switch at the end of the first pulse to provide the second pulse whereby the control pulse sequence provides an improved rate of heat input to the print head by decreasing the time required for the print head to attain the desired printing temperature and maintaining said temperature for the duration of said second pulse.

2. The control circuit of claim 1 wherein the duration of the second pulse is longer than the duration of the first pulse.

3. The control circuit of claim 1 wherein the print head is at a standby temperature lower than that of the desired temperature between control pulse sequences.

4. The control circuit of claim 1 wherein the timer is an RC network having a time constant equivalent to the duration of the first pulse.

5. The control circuit of claim 1 wherein the control pulse sequence is initiated by a printing mode control signal.

6. The control circuit of claim 1 wherein the switch is a bipolar transistor.

7. A method for driving a thermal print head of a thermal printing apparatus, the print head oriented to transfer thermal energy to a thermally sensitive media, the print head transferring thermal energy to the media in a printing mode upon reaching a printing temperature, comprising the steps of:

applying a first electrical potential of a control pulse sequence to the print head for a first duration;

switching the electrical potential applied to the print head from the first electrical potential of the sequence to a second electrical potential of the sequence, the second electrical potential being lower than that of the first electrical potential and being applied to the print head for a longer duration whereby the control pulse sequence provides an improved rate of heat input to the print head.

8. An apparatus for printing characters comprising:

a thermal print head oriented to transfer thermal energy to a thermally sensitive media; and a control circuit for driving the print head comprising:

a switch operably linked to a power source and to the print head to provide a control pulse sequence, the control pulse sequence including a first pulse and a second pulse, the first pulse having a first electrical potential and being applied to the print head for a first duration to heat the print head to the desired temperature for initiating a print mode, and the second pulse having a second electrical potential lower than the electrical potential of the first pulse and being of a second duration to maintain the printing temperature of the printing head; and a timer for operating said switch at the end of the first pulse to provide the second pulse whereby the control pulse sequence provides an improved rate of heat input to the print head by decreasing the time required for the print head to attain the desired printing temperature and maintaining said for temperature for the duration of said second pulse.

9. The apparatus of claim 8 wherein the duration of the second pulse is longer than the duration of the first pulse.

10. The apparatus of claim 8 wherein the print head is at a standby temperature lower than that of the desired temperature between control pulse sequences.

11. The apparatus of claim 8 wherein the timer is an RC network having a time constant equivalent to the duration of the first pulse.

12. The apparatus of claim 8 wherein the control pulse sequence is initiated by a printing mode control signal.

13. The apparatus of claim 8 wherein the switch is a bipolar transistor.

14. A method for printing characters on a thermally sensitive media comprising the steps of:

applying a first electrical potential of a control pulse sequence to a thermal print head for a first duration;

switching the electrical potential applied to the print head from the first electrical potential of the sequence to a second electrical potential of the sequence, the second electrical potential being lower than that of the first electrical potential and being applied to the print head for a longer duration whereby, as a consequence of applying the first and the second electrical potentials, thermal energy is transferred from the print head to the thermally sensitive media thereby causing a character to be printed on the thermally sensitive media.

* * * * *